US005179810A

United States Patent [19]

Gename et al.

[11] Patent Number: 5,179,810

[45] Date of Patent: Jan. 19, 1993

[54] PANEL SYSTEM

[75] Inventors: John L. Gename, Naperville; David P. Evensen, Wheeling, both of Ill.

[73] Assignee: Nimlok Company, Niles, Ill.

[21] Appl. No.: 791,366

[22] Filed: Nov. 14, 1991

[51] Int. Cl.[5] ..... E04B 2/00

[52] U.S. Cl. ..... 52/240; 52/281; 52/769; 52/773; 160/135

[58] Field of Search ..... 52/586, 281, 769, 401, 52/482, 238.1, 239, 240, 241, 243.1, 393, 285, 747, 773; 160/135

[56] References Cited

U.S. PATENT DOCUMENTS

| | | | |
|---|---|---|---|
| 1,034,185 | 4/1912 | Armstrong | 52/142 |
| 2,481,794 | 9/1949 | Stitt | 52/773 X |
| 2,949,983 | 8/1960 | Gartner | 52/243.1 X |
| 3,189,135 | 6/1965 | Slowinski | 52/241 |
| 3,292,328 | 12/1966 | Lewis et al. | 52/238.1 |
| 3,310,917 | 3/1967 | Simon | 52/586 X |
| 3,312,025 | 4/1967 | Deakins | 52/239 |
| 3,640,039 | 2/1972 | McKee et al. | 52/586 X |
| 3,720,026 | 3/1973 | Gasteiger | 52/401 X |
| 3,866,370 | 2/1975 | Guarino et al. | 52/241 |
| 4,037,380 | 7/1977 | Pollock | 52/243.1 X |
| 4,102,089 | 7/1978 | Paisley | 52/243.1 X |
| 4,170,430 | 10/1979 | Mrotzek | 52/586 X |
| 4,434,596 | 3/1984 | McAgeer et al. | 52/243.1 |
| 5,007,222 | 4/1991 | Raymond | 52/586 |

FOREIGN PATENT DOCUMENTS

| | | | |
|---|---|---|---|
| 0091215 | 3/1958 | Norway | 52/243.1 |

*Primary Examiner*—Richard E. Chilcot, Jr.
*Assistant Examiner*—Robert J. Canfield
*Attorney, Agent, or Firm*—Leydig, Voit & Mayer

[57] ABSTRACT

A panel system is provided wherein a pair of adjacent display panels are removably interconnected. The system includes a tensioning member disposed within a peripheral track formed in each of the adjacent display panels. The tensioning member cooperates with an elongate link, which slidably engages the tracks of the adjacent panels and retains the link and tracks in a snug interfitting relation.

6 Claims, 2 Drawing Sheets

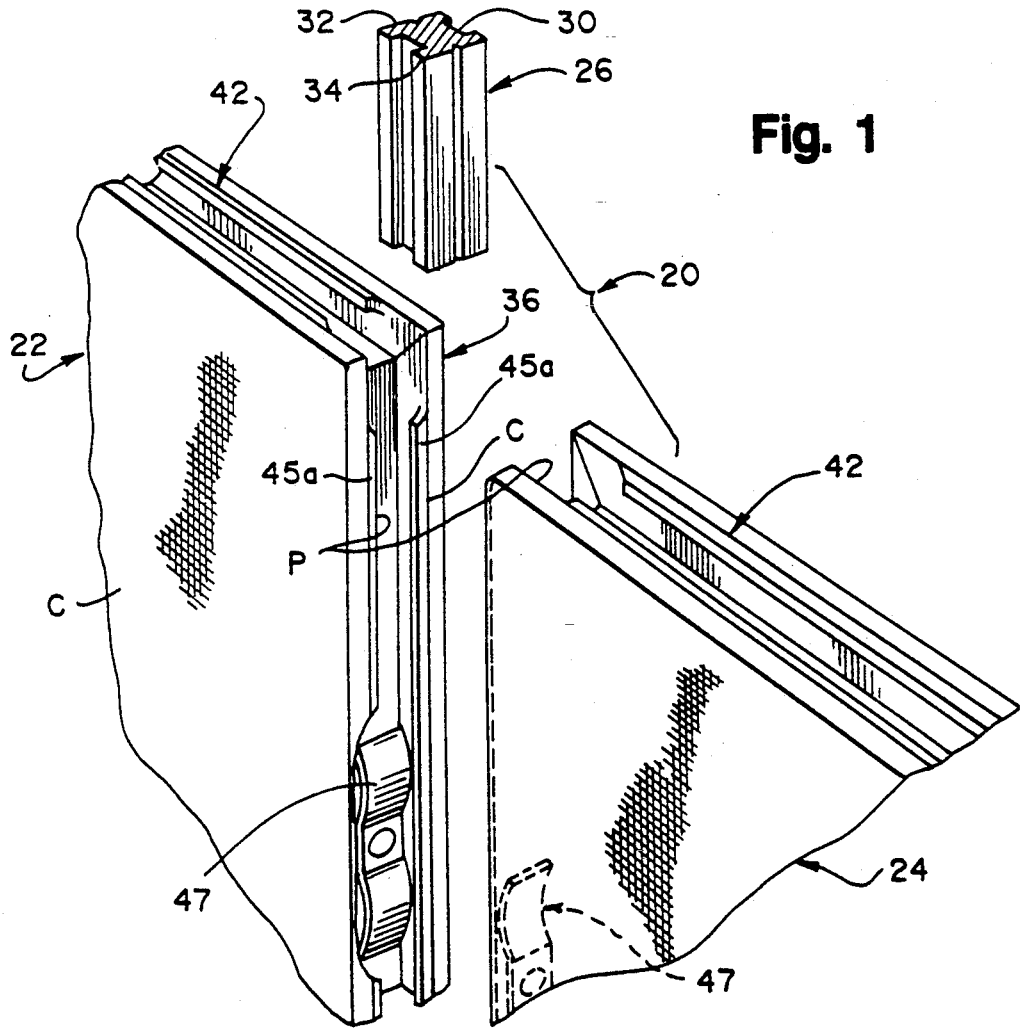
Fig. 1
Fig. 2
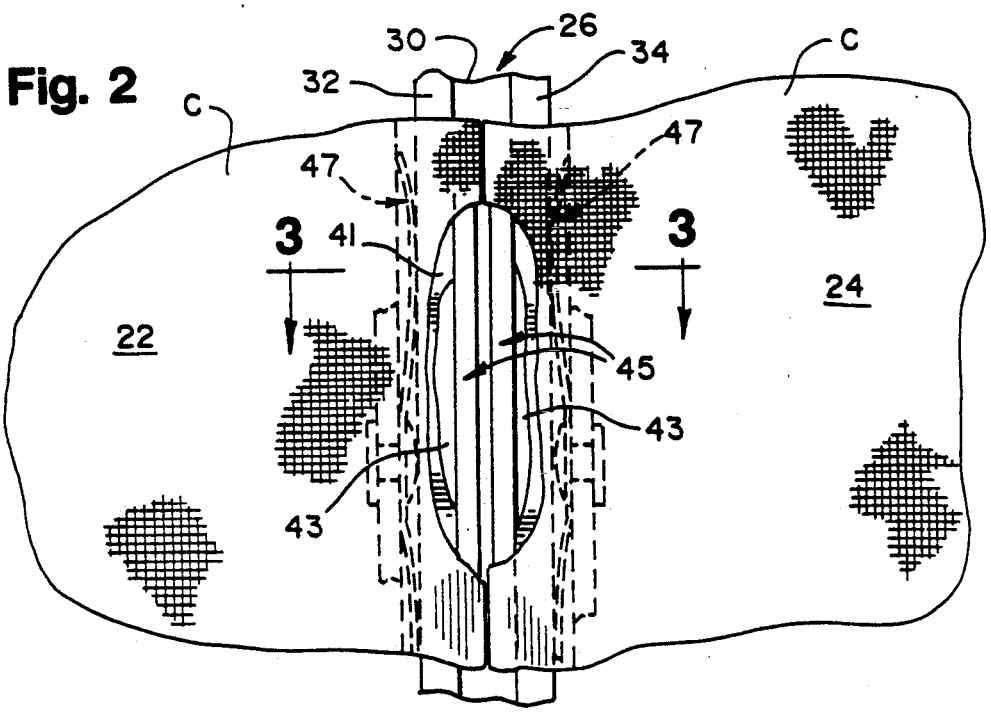

PANEL SYSTEM

BACKGROUND OF THE INVENTION

Various panel systems and components used therein have heretofore been widely utilized in setting up booths and various displays at conventions, trade shows, retail stores and the like. Such prior systems and components, however, are beset with one or more of the following shortcomings: (a) the systems when put together are unstable; (b) the system is difficult and awkward to setup and disassemble and requires the services of one or more skilled erectors; (c) the system includes an inordinate number of component parts; (d) to setup or disassemble the system requires special tools; (e) the components of the system are heavy, bulky and of costly, complex design; (f) the system is not readily adapted to be setup to assume a variety of aesthetic structural forms; (g) the number, size and relative location of the system components cannot be readily changed, (h) the system requires a variety of fasteners and/or clips which may be readily lost or misplaced; and (i) various components of the system require close manufacturing tolerances.

SUMMARY OF THE INVENTION

The present invention overcomes the drawbacks of these prior systems through the provision of a tensioning member positioned within tracks formed in the periphery of adjoining display panels. The tensioning member retains a slidable coupling member or link within the tracks of the panels being joined together and compensates for any play which might otherwise exist between the coupling member and accommodating tracks. The coupling member and tracks in combination with the tensioning members effectively support in a stable manner the entire system.

Additional fasteners, clips or clamps are not required to maintain the panels in interconnected relation.

A person with normal dexterity and strength may expeditiously assemble or disassemble the system components.

The improved partition system may incorporate panel components varying in size and shape over a wide range.

Further and additional advantages of the present invention will be apparent to those skilled in the art from the following description, accompanying drawings and the appended claims.

BRIEF DESCRIPTION OF THE DRAWINGS

For a more complete understanding of the invention, reference should be made to the accompanying drawings wherein:

FIG. 1 is a fragmentary, perspective view of one embodiment of the improved panel system showing the components thereof in an exploded relation.

FIG. 2 is a fragmentary front elevational view of the system of FIG. 1 with portions of the adjacent panels removed so as to reveal opposing segments of the peripheral tracks of said panels.

DETAILED DESCRIPTION OF THE INVENTION

Figure 3:
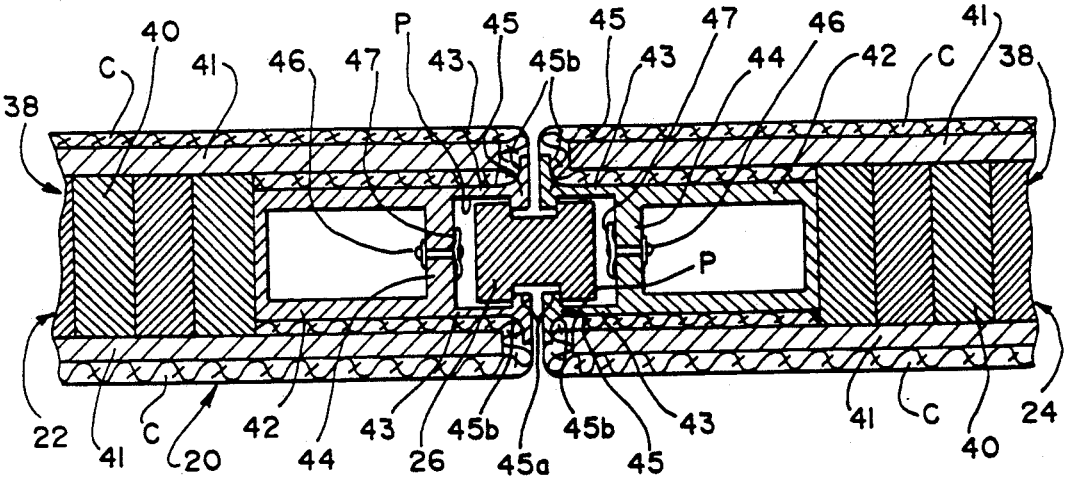
FIG. 3 is a sectional view taken along line 3—3 of FIG. 2.

Referring now to the drawings and more particularly to FIG. 1, one embodiment 20 of the improved partition system is shown immediately prior to assembly or following disassembly of various components thereof. System embodiment 20 basically includes a pair of adjacent panels 22, 24 and an elongate bar-like link 26 disposed therebetween. The panels in the system are easily interchangeable and may vary in shape and size.

The preferred link 26, sometimes referred hereafter as a complemental, second lock component, has an I-beam shape with a central or web portion 30 spanning the distance between a pair of oppositely disposed end portions 32, 34. Each end portion 32, 34 is preferably of like configuration and is adapted to slidably engage a corresponding track 36 formed in the periphery of the panel 22 or 24. The link may be formed of lightweight metal (e.g., tempered aluminum) or a rigid plastic material (e.g. polyethylene) and has a length which preferably overlaps the length of the track engaged thereby. In this way, the link connects the panels to prevent relative longitudinal and transverse movement of the panels.

Each panel 22, 24 is normally of planar configuration and includes a center section 38 having at least one rectilinear peripheral segment thereof provided with the track 36, sometimes referred to hereafter as a complemental first lock component. As seen in FIG. 3, the panel center section 38 may be of laminated construction and includes a core or infill member 40, which may be of a lightweight honey-comb material preferably fabricated of paper; outer lamina 41 adhesively secured to opposite exposed surfaces of the core member 40; and a frame 42 encompassing the peripheries of the core member 40 and outer lamina 41. The frame 42 may be of an extruded, lightweight metal and has a channel-like cross-sectional configuration, see FIG. 3. The frame 42 includes a pair of spaced substantially parallel side portions 43 which extend perpendicularly outwardly from a center portion 44. The exposed ends of side portions 43 are provided with transversely extending flanges 45. Each flange projects in opposite directions from the corresponding side portion. Corresponding inner segments 45*a* of the flanges cooperate with the side portions 43 and center portion 44 of the frame to form an elongate pocket P in which the link 26 is slidably accommodated when the system 20 is set up. An outer segment 45*b* of each flange 45 preferably projects outwardly an amount equal to the thickness of the outer lamina 41 forming a part of the panel center section 38. As seen in FIG. 3, the exposed surface of each outer lamina may be covered with a decorative covering C of fabric or plastic material. Where such a covering is utilized, the margin thereof may conceal an exposed portion of the outer segment 45*b* of the frame flange. The frame center portion 44 is adhesively or mechanically secured to the peripheral edge of the core member 40.

Figure 4:
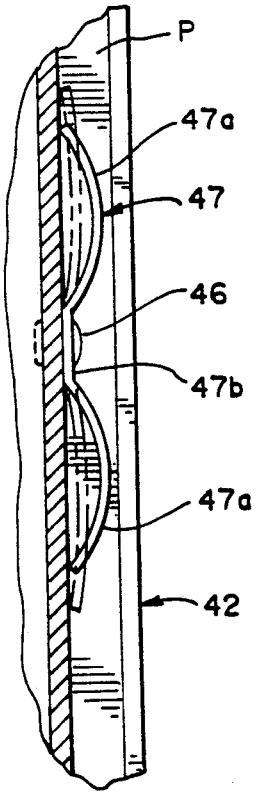
FIG. 4 is an enlarged fragmentary longitudinal sectional view of one peripheral track per se shown in FIG. 1 with a tensioning member thereof shown in phantom lines in an operative mode.
Figure 5:
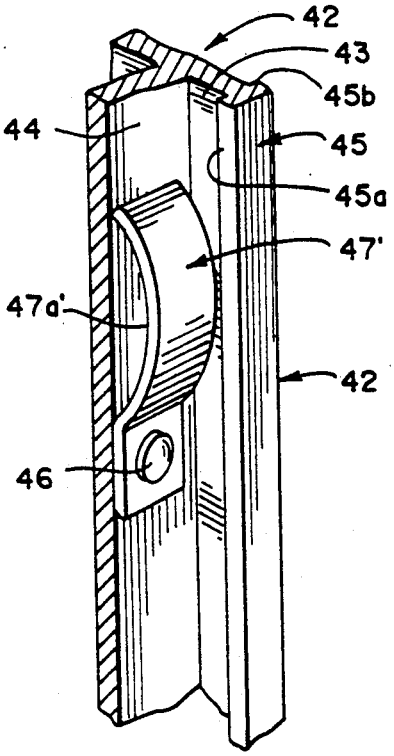
FIG. 5 is view of a track embodying an alternative form of tensioning member.
Figure 6:
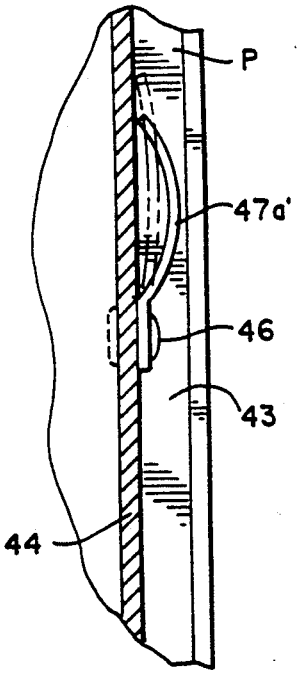
FIG. 6 is similar to FIG. 4 but of the track of FIG. 5.

Secured by rivets or screw fasteners 46 at longitudinally spaced locations on frame center portion 44 are leaf springs 47 or 47'. Spring 47 is provided with a pair of arcuate wing sections 47*a* which project in opposite directions from a center section 47*b*. The spring center section 47*b* is engaged by a rivet or screw fastener 46 and is affixed thereby to the frame center portion 44. Spring 47' differs from spring 47 in that it is provided with only one wing section 47'a, see FIGS. 5 and 6. The size of each leaf spring 47 or 47' is such that it can readily pass between an open side of the track pocket P, thus, facilitating mounting the spring on the frame center portion 44. The number of leaf springs per track will depend upon the track length. When a link 26 is accommodated in the tracks 36 of adjoining panels 22, 24 the arcuate wing sections 47a, 47'a are distorted by the link , see phantom lines in FIGS. 4 and 6, thus, causing the link end portions 32, 34 to snugly abut the inner segments 45a of the frame flanges 45, see FIG. 3 and avoid a loose interconnection between the panels and link 26. Besides avoiding the loose interconnection, the leaf springs 47, 47' avoid close manufacturing tolerances regarding the frame and/or link and cause the link to remain in interfitting relation with the track pockets due to increased friction.

When assembly of the system is desired, the link 26 is slid endwise into corresponding ends of the track pockets P of adjacent panels which had previously been arranged in side by side relation. To facilitate assembly of the link in the track pockets, the inner segments 45a of the panel frames adjacent the pocket ends, may be removed, as seen in FIG. 1 thereby effecting an enlarged opening in which to insert the end of the link 26.

Panels may be interchanged and added as desired. Since the leaf springs permit ease of sliding, minimal strength is required to insert and remove the links and no tools are required. The leaf springs are strong enough to maintain the link in frictional stable engagement in the tracks and yet permit repeated assembly and disassembly of the panel system.

While rectangular panels 22, 24 are shown as components of the improved system, the latter is not limited thereto. It is necessary, however, that the tracks 36 engaged by the link be rectilinear. The remainder of the periphery of each panel may assume various shapes and will depend upon the aesthetic appearance and function desired of the assembled system. Furthermore, the system's panels are shown arranged in side by side substantially coplanar relation, however, the invention is not intended to be limited thereto. For example, the panels may be disposed in angular relation in which case the web portion 30 of the link 26 may be curved or bent to the desired angle. The size and configuration of the link web portion are preferably such that, when the link is assembled in the panel track pockets, a very narrow joint is formed between the panels which does not distract from the aesthetic appearance of the setup system.

Thus, an improved panel system has been provided which is of simple stable construction; may be readily assembled and disassembled with a minimum amount of manual effort and without tools; and is easy and inexpensive to manufacture. When the system is disassembled the components thereof which are few in number, may be arranged in a portable compact unit.

What is claimed is:

1. A prefabricated panel system comprising a pair of panels arranged in adjacent relation with corresponding peripheral portions thereof disposed in close proximity to one another, each peripheral portion including a complemental first lock component; a complemental second lock component disposed intermediate said panel peripheral portions and in sliding interlocking relation with each of said complemental first lock components; and tensioning means mounted on one of the complemental lock components and, when said second lock component slidably interlocks with said first lock components, said tensioning means resiliently engages said first and second lock components and retains same in a snug interlocking relation, said tensioning means further permitting sliding disengagement between said first and second lock components such that said panels may be readily engaged and disengaged by manual adjustment.

2. The panel system of claim 1 wherein said second lock component includes a rod-like link and each first lock component includes a peripheral track; said link and each track being in interfitting relation and interlocking the adjacent panels.

3. The panel system of claim 2 wherein said link includes a pair of oppositely disposed laterally protruding end portions interconnected by a central portion; each end portion slidably interfitting with a track of an adjacent panel and said central portion spanning the distance between the tracks of the adjacent panels.

4. The panel system of claim 2 wherein each track includes at least one tensioning means; said means being disposed between a portion of said link and an opposed portion of said track and in resilient engagement therewith.

5. The panel system of claim 4 wherein said tensioning means includes a leaf spring.

6. The panel system of claim 3 wherein each track includes an elongate pocket having an open side, the open sides of the adjacent panel tracks being in proximate aligned relation, each open side being sized to accommodate only a portion of the central portion of said link, the end portions of said link being disposed within corresponding track pockets and being impassable with respect to the open sides of said pockets when said link is in interfitting relation with said adjacent panel tracks.

* * * * *